US006240571B1

(12) United States Patent
Infusino

(10) Patent No.: US 6,240,571 B1
(45) Date of Patent: Jun. 5, 2001

(54) PROTECTIVE HELMET WITH ADJUSTABLE SIZES

(75) Inventor: Ralph J. Infusino, Bloomingdale, IL (US)

(73) Assignee: Riddell, Inc., Chicago, IL (US)

( * ) Notice: Subject to any disclaimer, the term of this patent is extended or adjusted under 35 U.S.C. 154(b) by 0 days.

(21) Appl. No.: 09/435,937

(22) Filed: Nov. 9, 1999

(51) Int. Cl.[7] ..... A42B 3/10
(52) U.S. Cl. ..... 2/414; 2/418
(58) Field of Search ..... 2/410, 411, 413, 2/414, 417, 418, 419, 420, 425

(56) References Cited

U.S. PATENT DOCUMENTS 2,969,547 * 1/1961 Dye ..... 2/411
3,153,792 * 10/1964 Marietta ..... 2/414
4,843,642 * 7/1989 Brower ..... 2/6
5,930,840 * 8/1999 Arai ..... 2/411
6,085,357 * 7/2000 Broersma ..... 2/416

* cited by examiner

*Primary Examiner*—Michael A. Neas

(57) ABSTRACT

An adjustable helmet liner for a protective helmet is disclosed. The adjustable helmet liner comprises at least one liner wall having a peripheral surface adapted to substantially conform to, and fit within, the protective helmet for engagement with the head of a wearer of the protective helmet. The at least one liner wall includes an outer surface and an inner surface. The outer surface is adapted to be disposed adjacent the interior surface of the helmet and the inner surface is adapted to be spaced from the interior surface of the helmet whereby the liner may be inserted into the protective helmet and adjusts to the head of the wearer of the protective helmet. The adjustable helmet liner further includes at least one expandable band disposed along a portion of the outer surface of the liner wall, whereby the at least one expandable band provides for the adjustment of the liner to the head of the wearer of the protective helmet. A protective helmet having an adjustable helmet liner is also disclosed.

22 Claims, 2 Drawing Sheets

PROTECTIVE HELMET WITH ADJUSTABLE SIZES

BACKGROUND OF THE INVENTION

1. Field of the Invention

The invention relates to a protective helmet. More particularly, the invention relates to a protective helmet having an adjustable helmet liner for permitting the protective helmet to be worn by individuals having different sized heads.

2. Description of the Related Art

In order to provide less expensive protective headgear, or protective helmets, sacrifices are often made from the standpoint of fitting of the protective helmet and also from the standpoint of protection. For example, in cases where individuals are required to use the same helmet, e.g., hardhats used in construction and batting helmets in baseball, a less than perfect fit is often tolerated in order to save money by purchasing protective helmets that are not adjustable. In these cases, protection of the individual's head may be lessened because of the less than perfect fit of the protective helmet on the individual's head.

Prior attempts to provide a protective helmet capable of automatically adjusting to the head size of the individual wearing the protective helmet have included utilization of an elastic band disposed within the protective helmet that can be expanded to the size of the individual's head. Because only an elastic band captures the head of the individual, it is contemplated that these protective helmets do not adequately secure the head of the individual within the protective helmet.

Accordingly, prior to the development of the present invention, there has been no protective helmet which: provides simple adjustment to different sizes; provides automatic adjustment to different sizes; and provides increased security of the protective helmet to the head of the wearer of the protective helmet. Therefore, the art has sought a protective helmet which: provides simple adjustment to different sizes; provides automatic adjustment to different sizes; and provides increased security of the protective helmet to the head of the wearer of the protective helmet.

It should be noted that as to the protective helmet and the adjustable helmet liner of the present invention, as well as prior art protective helmets and adjustable helmet liners, due to the nature of the sports of football, baseball and cycling, construction work and other activities in which individuals wear protective headgear, no protective equipment can completely prevent injuries to those wearing the protective helmet and adjustable helmet liner. It should be further noted that no protective equipment can completely prevent injuries to an individual if the individual uses his protective helmet or adjustable helmet liner in an improper manner. No protective helmet or adjustable helmet liner, such as those of the present invention, can prevent all head, chin, or neck injuries an individual might receive while participating in any activity in which the protective helmet or adjustable helmet liner is worn, particularly if the individual improperly uses his protective helmet or adjustable helmet liner.

SUMMARY OF INVENTION

In accordance with the invention the foregoing advantages have been achieved through the present adjustable helmet liner for a protective helmet having an interior surface, the adjustable helmet liner comprising: at least one liner wall having a peripheral surface adapted to substantially conform to, and fit within, the protective helmet for engagement with the head of a wearer of the protective helmet, the at least one liner wall having an outer surface and an inner surface, the outer surface adapted to be disposed adjacent the interior surface of the helmet and the inner surface adapted to be spaced from the interior surface of the helmet whereby the liner may be inserted into the protective helmet and adjusts to the head of the wearer of the protective helmet; and at least one expandable band disposed along a portion of the outer surface of the liner wall, whereby the at least one expandable band provides for the adjustment of the liner to the head of the wearer of the protective helmet.

A further feature of the adjustable helmet liner is that the at least one liner wall may include at least one helmet attachment aperture adapted to connect the adjustable helmet liner to the protective helmet. Another feature of the adjustable helmet liner is that the at least one liner wall may include at least one band attachment aperture adapted to connect the at least one expandable band to the at least one liner wall. An additional feature of the adjustable helmet liner is that the inner surface of the at least one liner wall may include at least one impact absorption pad. A further feature of the adjustable helmet liner is that the at least one impact absorption pad may be formed of a plastic foam material. Another feature of the adjustable helmet liner is that the plastic foam material may be a closed cell plastic foam material. An additional feature of the adjustable helmet liner is that the closed cell plastic foam material may be cross-linked polyethylene. A further feature of the adjustable helmet liner is that the at least one liner wall may be formed of a plastic material.

In accordance with the invention the foregoing advantages have also been achieved through the present adjustable helmet liner for a protective helmet having an interior surface, the adjustable helmet liner comprising: at least one liner wall having a peripheral surface adapted to substantially conform to, and fit within, the protective helmet for engagement with the head of a wearer of the protective helmet, the at least one liner wall having an outer surface and an inner surface, the outer surface adapted to be disposed adjacent the interior surface of the helmet and the inner surface adapted to be spaced from the interior surface of the helmet whereby the liner may be inserted into the protective helmet and adjusts to the head of the wearer of the protective helmet; a first side wall having a first longitudinal axis and a plurality of edge surfaces; a first attachment wall disposed along the second edge surface; a second side wall having a second longitudinal axis and a plurality of edge surfaces; a second attachment wall disposed along the sixth edge surface; a rear wall having a third longitudinal axis and a plurality of edge surfaces; a third attachment wall disposed along the tenth edge surface; and an apex defined by the intersection of the first, second, and third attachment walls.

A further feature of the adjustable helmet liner is that the adjustable helmet liner may include at least one expandable band associated with the at least one liner wall. Another feature of the adjustable helmet liner is that each of the first, second, and rear walls may include at least one band attachment aperture adapted to connect the at least one expandable band to the first, second, and rear walls. An additional feature of the adjustable helmet liner is that each of the first, second, and rear walls may include at least one impact absorption pad. A further feature of the adjustable helmet liner is that the at least one liner wall may include at least one helmet attachment aperture adapted to connect the adjustable helmet liner to the protective helmet. Another feature of the adjustable helmet liner is that the plurality of edge surfaces of the first side wall may include first, second, third, and fourth edge surfaces, the first and third edge surfaces being disposed substantially perpendicular to the first longitudinal axis, and the second and fourth edge surfaces being disposed substantially parallel to the first longitudinal axis. An additional feature of the adjustable helmet liner is that the plurality of edge surfaces of the second side wall may include fifth, sixth, seventh and eighth edge surfaces, the fifth and seventh edge surfaces being disposed substantially perpendicular to the second longitudinal axis, and the sixth and eighth edge surfaces being disposed substantially parallel to the second longitudinal axis. A further feature of the adjustable helmet liner is that the plurality of edge surfaces of the rear wall may include ninth, tenth, eleventh and twelfth edge surfaces, the ninth and eleventh edge surfaces being disposed substantially perpendicular to the third longitudinal axis, and the tenth and twelfth edge surfaces being disposed substantially parallel to the third longitudinal axis.

In accordance with the invention the foregoing advantages have also been achieved through the present protective helmet comprising: a helmet shell having an interior surface, portions of the interior surface having pad structures disposed thereon in a spaced relationship, other portions of the interior surface being exposed in the spaces between the pad structures; an adjustable helmet liner for the helmet shell, the adjustable helmet liner including a liner wall having a peripheral surface adapted to substantially conform to, and fit within, the spaces between the pad structures of the helmet for engagement with the head of a wearer of the protective helmet, the at least one liner wall having an outer surface and an inner surface, the outer surface adapted to be disposed adjacent the interior surface of the helmet and the inner surface adapted to be spaced from the interior surface of the helmet whereby the liner may be inserted into the protective helmet and adjusts to the head of the wearer of the protective helmet; and at least one expandable band disposed along a portion of the outer surface, whereby the at least one expandable band provides for the adjustment of the liner to the head of the wearer of the protective helmet.

A further feature of the protective helmet is that the at least one liner wall may include at least one helmet attachment aperture adapted to connect the adjustable helmet liner to the protective helmet. Another feature of the protective helmet is that the at least one liner wall may include at least one band attachment aperture adapted to connect the at least one expandable band to the at least one liner wall. An additional feature of the protective helmet is that the inner surface of the at least one liner wall may include at least one impact absorption pad. A further feature of the protective helmet is that the at least one liner wall may be formed of a plastic material.

The adjustable helmet liner and protective helmet of the present invention, when compared with previously proposed adjustable helmet liners and protective helmets, have the advantages of: providing simple adjustment to different sizes; providing automatic adjustment to different sizes; and providing increased security of the protective helmet to the head of the wearer of the protective helmet.

While the invention will be described in connection with the preferred embodiment, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION AND SPECIFIC EMBODIMENTS

Figure 3:
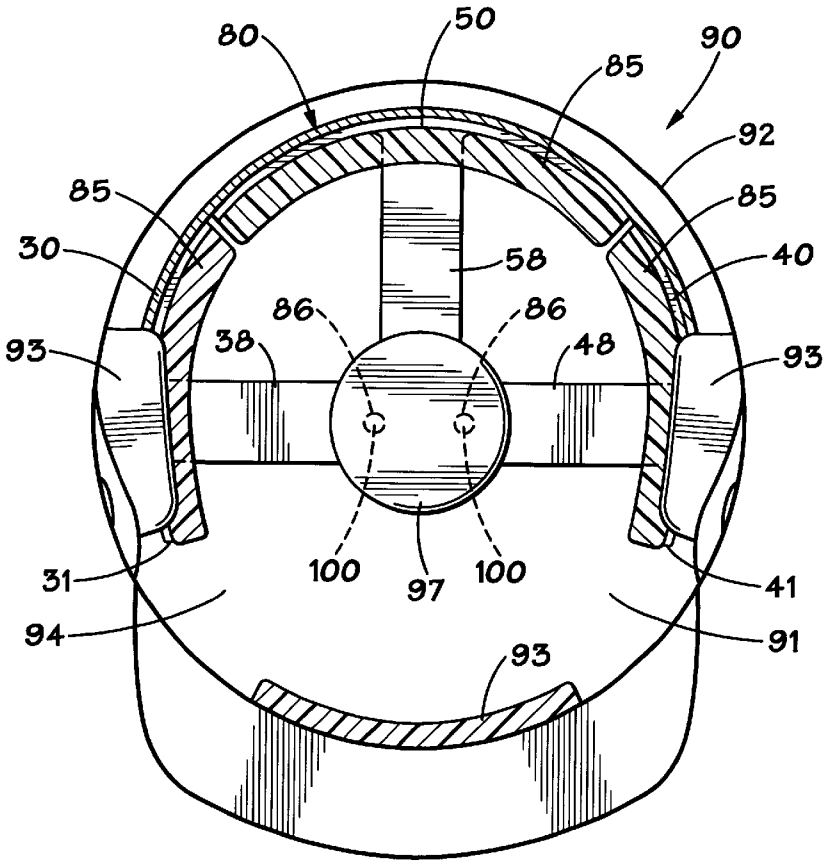
FIG. 3 is a bottom view of one specific embodiment of the protective helmet of the present invention.
Figure 1:
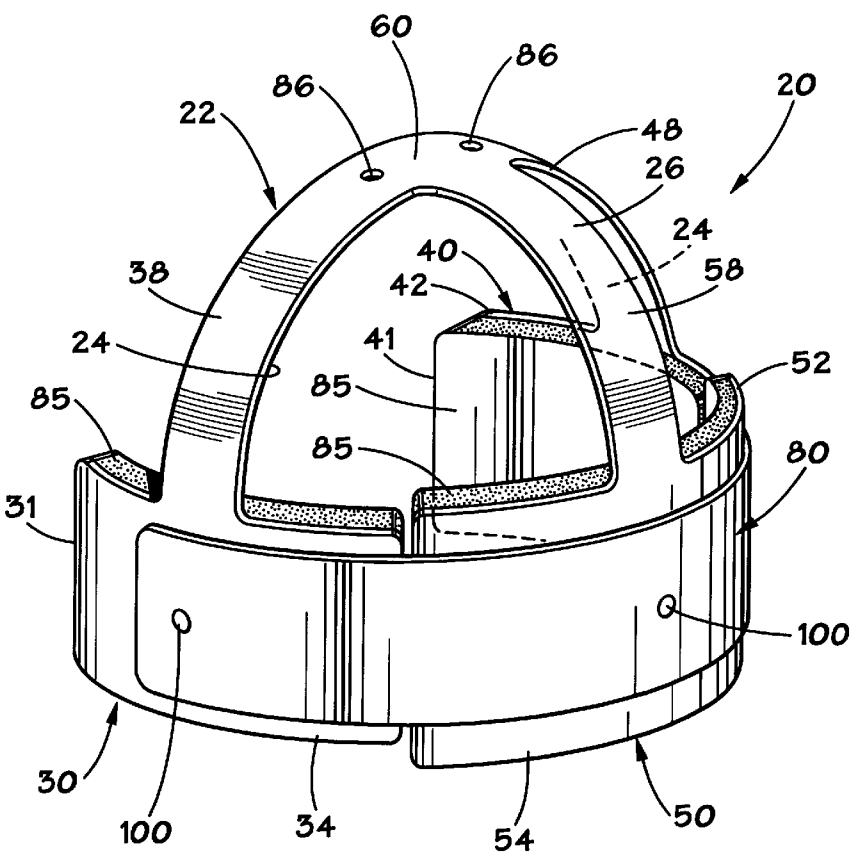
FIG. 1 is a perspective view of one specific embodiment of the adjustable helmet liner of the present invention.
Figure 2:
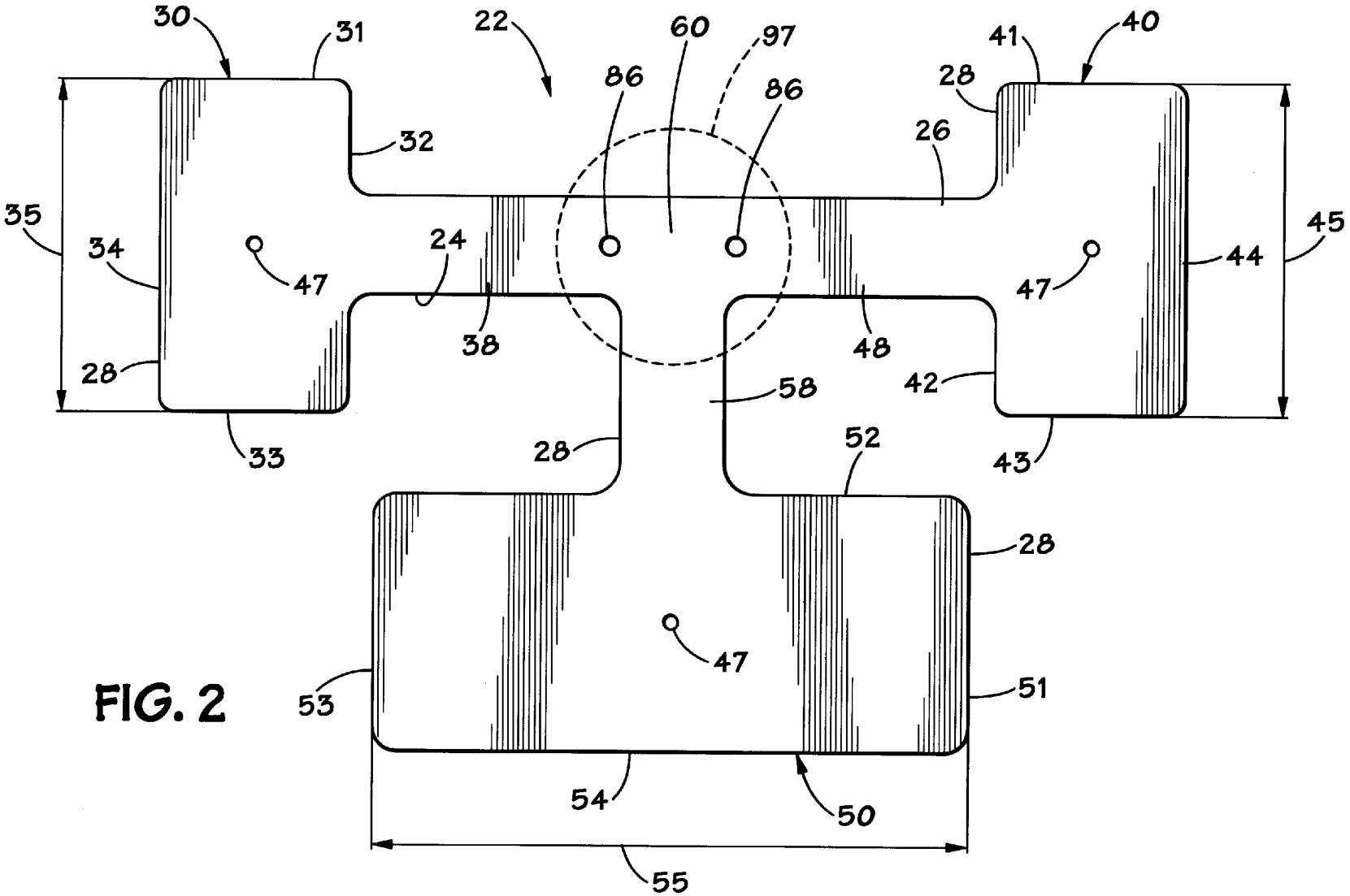
FIG. 2 is a planar view of the helmet liner of the adjustable helmet liner shown in FIG. 1.

The present invention is directed to a protective helmet 90 (FIG. 3), and in particular an adjustable helmet liner 20 for permitting individuals having different sized heads to wear the protective helmet. Referring now to FIGS. 1–3, in one specific embodiment, an adjustable helmet liner 20 includes at least one liner wall 22. The at least one liner wall 22 includes an inner surface 24, an outer surface 26, and a peripheral surface 28. In the embodiment shown in FIGS. 1–3, the at least one liner wall 22 further includes a first side wall 30, a second side wall 40, and a rear wall 50. First side wall 30, second side wall 40 and rear wall 50 may have any shape desired or necessary to firmly capture the head of the individual wearing the protective helmet 90 in the adjustable helmet liner 20, but as shown in FIGS. 1 and 2 may be generally rectangular shaped.

The first side wall 30, second side wall 40, and rear wall 50 each include at least one side edge. In the embodiment in which any one or more of the first side wall 30, second side wall 40, and/or rear wall 50 are circularly-shaped (not shown), the first side wall 30, second side wall 40, and/or rear wall 50 include one side edge (not shown). In other embodiments, the first side wall 30, second side wall 40, or rear wall 50 include a plurality of side edges. In the embodiment shown in FIGS. 1–3, the first side wall 30, second side wall 40, and rear wall 50 are each rectangularly-shaped. In this embodiment, the first side wall 30 includes a first side edge 31, a second side edge 32, a third side edge 33, and a fourth side edge 34. First side wall 30 also includes a first longitudinal axis 35. Second side wall 40 includes a fifth side edge 41, a sixth side edge 42, a seventh side edge 43, an eighth side edge 44, and a second longitudinal axis 45. Rear wall 50 includes a ninth side edge 51, tenth side edge 52, eleventh side edge 53, a twelfth side edge 54, and third longitudinal axis 55. Although the shape of the first side wall 30, second side wall 40 and rear wall 50 may be any desired shape, preferably, the first side wall 30, second side wall 40 and rear wall 50 are concave on the inner surface 24 to generally conform to the curvatures of the head of the individual wearing the protective helmet 90.

The size of first side wall 30, second side wall 40 and rear wall 50 may be any size desired or necessary to adequately capture the head of the individual wearing the adjustable helmet liner 20. For example, the first side wall 30, second side wall 40 and rear wall 50 may be smaller for use by children and adolescents and larger for adults. Therefore, the desired size is easily determined by persons skilled in the art.

Still referring to FIGS. 1–3, first side wall 30, second side wall 40, and rear wall 50 are adapted to connect to each other by first attachment wall 38, second attachment wall 48, and third attachment wall 58. First attachment wall 38, second attachment wall 48, and third attachment wall 58 are adapted to connect to each other at apex 60. In the preferred embodiment, first side wall 30, second side wall 40, and rear wall 50 include at least one impact absorption pad 85.

The size and shape of the first attachment wall 38, second attachment wall 48, and third attachment wall 58 may be any size or shape desired or necessary to adequately capture the head of the individual wearing the adjustable helmet liner. For example, as shown in FIG. 2, the first attachment wall 38, second attachment wall 48, and third attachment wall 58 are substantially rectangularly shaped. The dimensions of the first attachment wall 38, second attachment wall 48, and third attachment wall 58 are easily determined by persons skilled in the art. As discussed above in connection with the size of the first side wall 30, second side wall 40, and rear wall 50, the size of the first attachment wall 38, second attachment wall 48, and third attachment wall 58 are smaller for children and adolescents and larger for adults.

In a preferred embodiment, the adjustable helmet liner 20 includes at least one expandable band 80. The expandable band 80 may be secured to the adjustable helmet liner 20 by any device or method known by persons skilled in the art. As shown in FIG. 1, the expandable band 80 is secured to the first side wall 30, second side wall 40, and rear wall 50 by securing members 100. Securing members 100 may be screws, rivets, or any other device known in the art. In the embodiments in which securing members 100 are screws, rivets or any other device that requires the securing member 100 to be placed through the first side wall 30, second side wall 40, and/or rear wall 50, the first side wall 30, second side wall 40 and/or rear side wall 50 include at least one side wall aperture 47.

Referring now to FIG. 3, adjustable helmet liner 20 is disposed within a protective helmet 90. Protective helmet may be a football helmet, baseball helmet, bicycle helmet, construction helmet, or any other device worn on the head of an individual to capture the head of the individual within the protective helmet 90. As shown in FIG. 3, protective helmet 90 is a batter's helmet and includes a helmet inner surface 91, a helmet outer surface 92, and various pad structures 93 disposed along the helmet inner surface 91 to adsorb force to the outer surface 92 of the protective helmet 90 and dissipate the force such that the strength of the force is lessened before reaching the head of the individual wearing the protective helmet 90. The various pad structures 93 may be any shape or sized desired or necessary to capture the head of the individual wearing the protective helmet 90 and may be placed at any location along the helmet inner surface 91, such location is readily known by persons skilled in the art. Spaces 94 are located along the helmet inner surface 91 and in between the pad structures 93. The adjustable helmet liner 20 is placed within these spaces 94 and secured to the protective helmet 90. As shown in FIG. 3, adjustable helmet liner 20 is secured to the protective helmet 90 by placing securing members 100 through helmet liner apertures 86 and protective helmet apertures (not shown).

In a preferred embodiment, after the adjustable helmet liner 20 is connected to the protective helmet 90, a crown pad 97 is disposed over the apex 60 of the adjustable helmet liner 20 to provide cushioning between the top of the head of the individual wearing the protective helmet 90 and the adjustable helmet liner 20.

It is to be understood that the invention is not limited to the exact details of construction, operation, exact materials, or embodiments shown and described, as obvious modifications and equivalents will be apparent to one skilled in the art. For example, expandable band 80 may be one continuous band or a plurality of expandable bands, provided the plurality of expandable bands permit the adjustable helmet liner 20 to adjust to the heads of individuals having different sized heads. Accordingly, the invention is therefore to be limited only by the scope of the appended claims.

What is claimed is:

1. An adjustable helmet liner for a protective helmet having an interior surface, the adjustable helmet liner comprising:

at least one liner wall having a peripheral surface adapted to substantially conform to, and fit within, the protective helmet for engagement with the head of a wearer of the protective helmet, the at least one liner wall having an outer surface and an inner surface, the outer surface adapted to be disposed adjacent the interior surface of the helmet and the inner surface adapted to be spaced from the interior surface of the helmet whereby the liner may be inserted into the protective helmet and adjusts to the head of the wearer of the protective helmet;

at least one expandable band disposed along a portion of the outer surface of the liner wall, whereby the at least one expandable band provides for the adjustment of the liner to the head of the wearer of the protective helmet; and at least one helmet attachment aperture disposed on the liner wall adapted to connect the adjustable helmet liner to the protective helmet.

2. The adjustable helmet liner of claim 1, wherein the at least one liner wall includes at least one band attachment aperture adapted to connect the at least one expandable band to the at least one liner wall.

3. The adjustable helmet liner of claim 1, wherein the inner surface of the at least one liner wall includes at least one impact absorption pad.

4. The adjustable helmet liner of claim 3, wherein the at least one impact absorption pad is formed of a plastic foam material.

5. The adjustable helmet liner of claim 4, wherein the plastic foam material is a closed cell plastic foam material.

6. The adjustable helmet liner of claim 5, wherein the closed cell plastic foam material is crosslinked polyethylene.

7. The adjustable helmet liner of claim 1, wherein the at least one liner wall is formed of a plastic material.

8. An adjustable helmet liner for a protective helmet having an interior surface, the adjustable helmet liner comprising:

at least one liner wall having a peripheral surface adapted to substantially conform to, and fit within, the protective helmet for engagement with the head of a wearer of the protective helmet, the at least one liner wall having an outer surface and an inner surface, the outer surface adapted to be disposed adjacent the interior surface of the helmet and the inner surface adapted to be spaced from the interior surface of the helmet whereby the liner may be inserted into the protective helmet and adjusts to the head of the wearer of the protective helmet;

a first side wall having a first longitudinal axis and a plurality of edge surfaces;

a first attachment wall disposed along a second edge surface of the first side wall;

a second side wall having a second longitudinal axis and a plurality of edge surfaces;

a second attachment wall disposed along a sixth edge surface of the second side wall;

a rear wall having a third longitudinal axis and a plurality of edge surfaces;

a third attachment wall disposed along a tenth edge surface of the rear wall;

an apex defined by the intersection of the first, second, and third attachment walls; and at least one helmet attachment aperture disposed on the at least one liner wall adapted to connect the adjustable helmet liner to the protective helmet.

9. The adjustable helmet liner of claim 8, further including at least one expandable band associated with the at least one liner wall.

10. The adjustable helmet liner of claim 9, wherein each of the first, second, and rear walls includes at least one band attachment aperture adapted to connect the at least one expandable band to the first, second, and rear walls.

11. The adjustable helmet liner of claim 8, wherein each of the first, second, and rear walls includes at least one impact absorption pad.

12. The adjustable helmet liner of claim 8, wherein the plurality of edge surfaces of the first side wall includes first, second, third, and fourth edge surfaces, the first and third edge surfaces being disposed substantially perpendicular to the first longitudinal axis, and the second and fourth edge surfaces being disposed substantially parallel to the first longitudinal axis.

13. The adjustable helmet liner of claim 12, wherein the plurality of edge surfaces of the second side wall includes fifth, sixth, seventh and eighth edge surfaces, the fifth and seventh edge surfaces being disposed substantially perpendicular to the second longitudinal axis, and the sixth and eighth edge surfaces being disposed substantially parallel to the second longitudinal axis.

14. The adjustable helmet liner of claim 13, wherein the plurality of edge surfaces of the rear wall includes ninth, tenth, eleventh and twelfth edge surfaces, the ninth and eleventh edge surfaces being disposed substantially perpendicular to the third longitudinal axis, and the tenth and twelfth edge surfaces being disposed substantially parallel to the third longitudinal axis.

15. A protective helmet comprising:

a helmet shell having an interior surface, portions of the interior surface having pad structures disposed thereon in a spaced relationship, other portions of the interior surface being exposed in the spaces between the pad structures;

an adjustable helmet liner for the helmet shell, the adjustable helmet liner including a liner wall having a peripheral surface adapted to substantially conform to, and fit within, the spaces between the pad structures of the helmet for engagement with the head of a wearer of the protective helmet, the at least one liner wall having an outer surface and an inner surface, the outer surface adapted to be disposed adjacent the interior surface of the helmet and the inner surface adapted to be spaced from the interior surface of the helmet whereby the liner may be inserted into the protective helmet and adjusts to the head of the wearer of the protective helmet;

at least one expandable band disposed along a portion of the outer surface, whereby the at least one expandable band provides for the adjustment of the liner to the head of the wearer of the protective helmet; and at least one helmet attachment fastener disposed on the liner wall adapted to connect the adjustable helmet liner to the protective helmet.

16. The protective helmet of claim 15, wherein the at least one liner wall includes at least one helmet attachment aperture adapted to connect the adjustable helmet liner to the protective helmet.

17. The protective helmet of claim 15, wherein the at least one liner wall includes at least one band attachment aperture adapted to connect the at least one expandable band to the at least one liner wall.

18. The protective helmet of claim 15, wherein the inner surface of the at least one liner wall includes at least one impact absorption pad.

19. The protective helmet of claim 15, wherein the at least one liner wall is formed of a plastic material.

20. An adjustable helmet liner for a protective helmet having an interior surface, the adjustable helmet liner comprising:

at least one liner wall having a peripheral surface adapted to substantially conform to, and fit within, the protective helmet for engagement with the head of a wearer of the protective helmet, the at least one liner wall having an outer surface and an inner surface, the outer surface adapted to be disposed adjacent the interior surface of the helmet and the inner surface adapted to be spaced from the interior surface of the helmet whereby the liner may be inserted into the protective helmet and adjusts to the head of the wearer of the protective helmet;

at least one expandable band disposed along a portion of the outer surface of the liner wall, whereby at least one expandable band provides for the adjustment of the liner to the head of the wearer of the protective helmet; and at least one impact absorption pad disposed on the inner surface of the at least one liner wall.

21. An adjustable helmet liner for a protective helmet having an interior surface, the adjustable helmet liner comprising:

at least one liner wall having a peripheral surface adapted to substantially conform to, and fit within, the protective helmet for engagement with the head of a wearer of the protective helmet, the at least one liner wall having an outer surface and an inner surface, the outer surface adapted to be disposed adjacent the interior surface of the helmet and the inner surface adapted to be spaced from the interior surface of the helmet whereby the liner may be inserted into the protective helmet and adjusts to the head of the wearer of the protective helmet;

a first side wall having a first longitudinal axis and a plurality of edge surfaces;

a first attachment wall disposed along a second edge surface of the first side wall;

a second side wall having a second longitudinal axis and a plurality of edge surfaces;

a second attachment wall disposed along a sixth edge surface of the second side wall;

a rear wall having a third longitudinal axis and a plurality of edge surfaces;

a third attachment wall disposed along a tenth edge surface of the rear wall;

an apex defined by the intersection of the first, second, and third attachment walls; and at least one impact absorption pad disposed on each of the first, second and rear walls.

22. A protective helmet comprising:

a helmet shell having an interior surface, portions of the interior surface having pad structures disposed thereon in a spaced relationship, other portions of the interior surface being exposed in the spaces between the pad structures;

an adjustable helmet liner for the helmet shell, the adjustable helmet liner including a liner wall having a peripheral surface adapted to substantially conform to, and fit within, the spaces between the pad structures of the helmet for engagement with the head of a wearer of the protective helmet, the at least one liner wall having an outer surface and an inner surface, the outer surface adapted to be disposed adjacent the interior surface of the helmet and the inner surface adapted to be spaced from the interior surface of the helmet whereby the liner may be inserted into the protective helmet and adjusts to the head of the wearer of the protective helmet;

at least one expandable band disposed along a portion of the outer surface, whereby the at least one expandable band provides for the adjustment of the liner to the head of the wearer of the protective helmet; and at least one impact absorption pad disposed on the inner surface of the at least one liner wall.

* * * * *